US009953593B2

(12) United States Patent
Wu et al.

(10) Patent No.: US 9,953,593 B2
(45) Date of Patent: Apr. 24, 2018

(54) LIQUID CRYSTAL DISPLAY AND CONTROL SIGNAL DEBUGGING METHOD THEREOF

(71) Applicant: Shenzhen China Star Optoelectronics Technology Co., Ltd., Shenzhen, Guangdong (CN)

(72) Inventors: Yu Wu, Guangdong (CN); Lei Wang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 183 days.

(21) Appl. No.: 14/901,333

(22) PCT Filed: Oct. 15, 2015

(86) PCT No.: PCT/CN2015/091995

§ 371 (c)(1),
(2) Date: Dec. 28, 2015

(87) PCT Pub. No.: WO2017/049681

PCT Pub. Date: Mar. 30, 2017

(65) Prior Publication Data

US 2017/0084236 A1 Mar. 23, 2017

(30) Foreign Application Priority Data

Sep. 23, 2015 (CN) ..... 2015 1 0611730

(51) Int. Cl.
*G09G 3/36* (2006.01)

(52) U.S. Cl.
CPC ..... *G09G 3/3614* (2013.01); *G09G 2310/06* (2013.01); *G09G 2320/0693* (2013.01); *G09G 2330/12* (2013.01)

(58) Field of Classification Search
CPC ..... G09G 3/3614; G09G 2320/0693; G09G 2330/12; G09G 2310/06
See application file for complete search history.

(56) References Cited

U.S. PATENT DOCUMENTS

2007/0195078 A1 8/2007 Nagatsuka
2015/0379949 A1* 12/2015 Wang ..... G09G 3/3674 345/213

FOREIGN PATENT DOCUMENTS

CN 2000029419 A 1/2000
CN 101097708 A 1/2008
(Continued)

*Primary Examiner* — Abhishek Sarma
(74) *Attorney, Agent, or Firm* — Andrew C. Cheng

(57) ABSTRACT

The present invention provides a liquid crystal display, comprising a first circuit board and a second circuit board and a source driving circuit which are electrically coupled to the first circuit board, wherein the first circuit board comprises a sequence controller, and the sequence controller provides a control signal and codes the control signal, and transmits the coded control signal from the first circuit board to the source driving circuit through the second circuit board, and the sequence controller directly outputs the uncoded control signal through the first circuit board to ensure a phase delay relationship between the uncoded control signal and a control signal outputted by the source driving circuit. The present invention further provides a control signal debugging method applied with the aforesaid liquid crystal display.

18 Claims, 2 Drawing Sheets

(56) References Cited

FOREIGN PATENT DOCUMENTS

| | | | |
|---|---|---|---|
| CN | 101202024 | A | 6/2008 |
| CN | 101226713 | A | 7/2008 |
| CN | 202159474 | U | 3/2012 |
| CN | 102662265 | A | 9/2012 |
| CN | 102939591 | A | 2/2013 |
| CN | 202771771 | A | 3/2013 |
| CN | 103166732 | A | 6/2013 |
| CN | 103531169 | A | 1/2014 |
| CN | 201429246 | A | 7/2014 |
| CN | 104103251 | A | 10/2014 |

* cited by examiner

LIQUID CRYSTAL DISPLAY AND CONTROL SIGNAL DEBUGGING METHOD THEREOF

CROSS REFERENCE

This application claims the priority of Chinese Patent Application No. 201510611730.X, entitled "Liquid crystal display and control signal debugging method thereof", filed on Sep. 23, 2015, the disclosure of which is incorporated herein by reference in its entirety.

FIELD OF THE INVENTION

The present invention relates to a liquid crystal display technology field, and more particularly to a liquid crystal display and a control signal debugging method thereof.

BACKGROUND OF THE INVENTION

As most of the liquid crystal display according to prior art utilizes signal transmission of Point to Point, the sequence controller (TCON) codes the control signal, such as the data source row latch signal (TP) and the signal (POL) controlling polarity reversal of the pixel voltage, and embeds the same in the differential signal to be transmitted from the first circuit board, such as C-board to the source driving circuit (source IC) through the second circuit board, such as X-board. The Source IC receives and decodes the differential signal and performs the subsequent signal process on demand. If it is going to measure the TP and POL signals after being decoded, the Source IC decodes and restores the control signal to be outputted to the second circuit board in a way of transistor-transistor logic voltage level for being employed to test the waveform and the sequence of the control signal.

However, after the control signal outputted by TCON has been through the subsequent code and decode processes, they cannot be directly measured on the first circuit board with the test apparatus. Thus, without the Source IC, the waveform and the sequence of the signal cannot be determined to be correct as modulating the initial control signal of TCON. Besides, as the image of the liquid crystal display appears to be abnormal, it is impossible to measure the waveform and the sequence of the control signal outputted by TCON in real time to determine whether they are correct, either. Certainly, there is no way to ensure whether the control signal outputted by TCON satisfies the requirement of the product or not.

SUMMARY OF THE INVENTION

An objective of the present invention is to provide a liquid crystal display and a control signal debugging method thereof, which can measure the waveform and the sequence of the control signal outputted by the sequence controller in real time to determine whether they are correct to ensure that the control signal outputted by the sequence controller satisfies the requirement of the product.

In one aspect, the present invention provides a liquid crystal display, and the liquid crystal display comprises a first circuit board and a second circuit board and a source driving circuit which are electrically coupled to the first circuit board, wherein the first circuit board comprises a sequence controller, and the sequence controller provides a control signal and codes the control signal, and transmits the coded control signal from the first circuit board to the source driving circuit through the second circuit board, and the sequence controller directly outputs the uncoded control signal through the first circuit board to ensure a phase delay relationship between the uncoded control signal and a control signal outputted by the source driving circuit.

The source driving circuit receives the control signal and decodes the same, and outputs the decoded control signal through the second circuit board; after the uncoded control signal through the first circuit board and the decoded control signal through the second circuit board are compared to determine the phase delay relationship of the two, the control signal received by the source driving circuit is restored in real time according to the phase delay relationship, or the control signal subsequently outputted by the sequence controller is adjusted according to the phase delay relationship.

The control signal comprises a data source row latch signal and a signal controlling polarity reversal of a pixel voltage.

The first circuit board is a X board of the liquid crystal display.

The second circuit board is a C board of the liquid crystal display.

The first circuit board comprises a first test point, and the second circuit board comprises a second test point, and the first test point and the second test point are coupled to an external test apparatus to measure a waveform and a sequence of the control signal in real time.

In another aspect, the present invention provides a control signal debugging method applied in a liquid crystal display, and the liquid crystal display comprises a first circuit board and a second circuit board and a source driving circuit which are electrically coupled to the first circuit board, and the first circuit board comprises a sequence controller, and the control signal debugging method comprises:

the sequence controller provides a control signal and codes the control signal; and the sequence controller transmits the coded control signal from the first circuit board to the source driving circuit through the second circuit board, and meanwhile, the sequence controller directly outputs the uncoded control signal through the first circuit board to ensure a phase delay relationship between the uncoded control signal and a decoded control signal outputted by the second circuit board.

The control signal debugging method further comprises steps of:

the source driving circuit receives the control signal and decodes the same, and outputs the decoded control signal through the second circuit board; and after the uncoded control signal through the first circuit board and the decoded control signal through the second circuit board are compared to determine the phase delay relationship of the two, the control signal received by the source driving circuit is restored in real time according to the phase delay relationship, or the control signal subsequently outputted by the sequence controller is adjusted according to the phase delay relationship.

The control signal comprises a data source row latch signal and a signal controlling polarity reversal of a pixel voltage.

The first circuit board is a X board of the liquid crystal display, and the second circuit board is a C board of the liquid crystal display.

The first circuit board comprises a first test point, and the second circuit board comprises a second test point, and the first test point and the second test point are coupled to an external test apparatus to measure a waveform and a sequence of the control signal in real time.

In comparison with prior art, the liquid crystal display and the control signal debugging method thereof according to the present invention can be directly coupled to the external test apparatus through the first circuit board to measure the waveform and the sequence of the control signal outputted by the sequence controller in real time and determine whether they are correct. Besides, the liquid crystal display and the control signal debugging method thereof according to the embodiment of the present invention also can ensure a phase delay relationship between the uncoded control signal outputted by the first circuit board and the decoded control signal outputted by the second circuit board to adjust the control signal outputted by the sequence controller according to the phase delay relationship.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Besides, the following descriptions for the respective embodiments are specific embodiments capable of being implemented for illustrations of the present invention with referring to appended figures. For example, the terms of up, down, front, rear, left, right, interior, exterior, side, etcetera are merely directions of referring to appended figures. Therefore, the wordings of directions are employed for explaining and understanding the present invention but not limitations thereto.

In the description of the invention, which needs explanation is that the term "installation", "connected", "connection" should be broadly understood unless those are clearly defined and limited, otherwise, For example, those can be a fixed connection, a detachable connection, or an integral connection; those can be a mechanical connection, or an electrical connection; those can be a direct connection, or an indirect connection with an intermediary, which may be an internal connection of two elements. To those of ordinary skill in the art, the specific meaning of the above terminology in the present invention can be understood in the specific circumstances.

Besides, in the description of the present invention, unless with being indicated otherwise, "plurality" means two or more. In the present specification, the term "process" encompasses an independent process, as well as a process that cannot be clearly distinguished from another process but yet achieves the expected effect of the process of interest. Moreover, in the present specification, any numerical range expressed herein using "to" refers to a range including the numerical values before and after "to" as the minimum and maximum values, respectively. In figures, the same reference numbers will be used to refer to the same or like parts.

Figure 1:
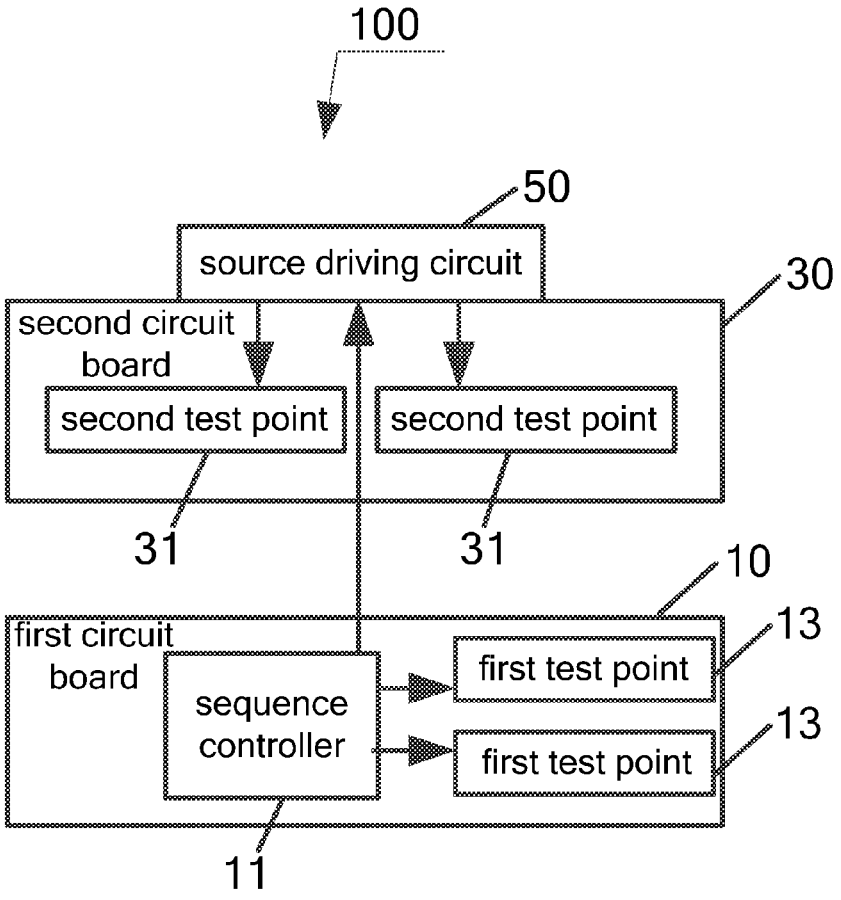
FIG. 1 is a functional block diagram of a liquid crystal display according to the embodiment of the present invention.

Please refer to FIG. 1. FIG. 1 is a functional block diagram of a liquid crystal display according to the present invention. As shown in FIG. 1, the liquid crystal display 100 shown in the embodiment of the present invention comprises a first circuit board 10, a second circuit board 30 and a source driving circuit 50. In the preferred embodiment, the first circuit board 10 is a C-board of the liquid crystal display, and the second circuit board 30 is a X-board of the liquid crystal display, which is electrically coupled to the first circuit board 10.

The first circuit board 10 comprises a sequence controller 11 and a first test point 13. The sequence controller 11 and the first test point 13 are electrically coupled to the second circuit board 30. The sequence controller 11 provides a control signal and codes the control signal, and transmits the coded control signal from the first circuit board 10 to the source driving circuit 50 through the second circuit board 30. Meanwhile, the sequence controller 11 also outputs the uncoded control signal to the first test point 13.

In this preferred embodiment, the control signal comprises a data source row latch signal (TP) and a signal (POL) controlling polarity reversal of a pixel voltage. Correspondingly, the amount of the first test points 13 is two, which respectively are employed to output the uncoded data source row latch signal and polarity reversal signal. In this preferred embodiment, the control signal is outputted to the first test point 13 in a way of transistor-transistor logic voltage level, and the test apparatus can be coupled to the first test point 13 to measure the waveform and the sequence of the control signal in real time.

The second circuit board 30 comprises a second test point 31. In this preferred embodiment, the amount of the second test points 31 is two.

The source driving circuit 50 receives the control signal from the second circuit board 30 and decodes the same, and outputs the decoded control signal to the second test point 31, and outputs the same through the second test point 31. After the uncoded control signal through the first circuit board 10 and the decoded control signal through the second circuit board 30 are compared to determine the phase delay relationship of the two, the control signal received by the source driving circuit 50 can be restored in real time according to the phase delay relationship, or the control signal subsequently outputted by the sequence controller 11 can be adjusted according to the phase delay relationship.

Figure 2:
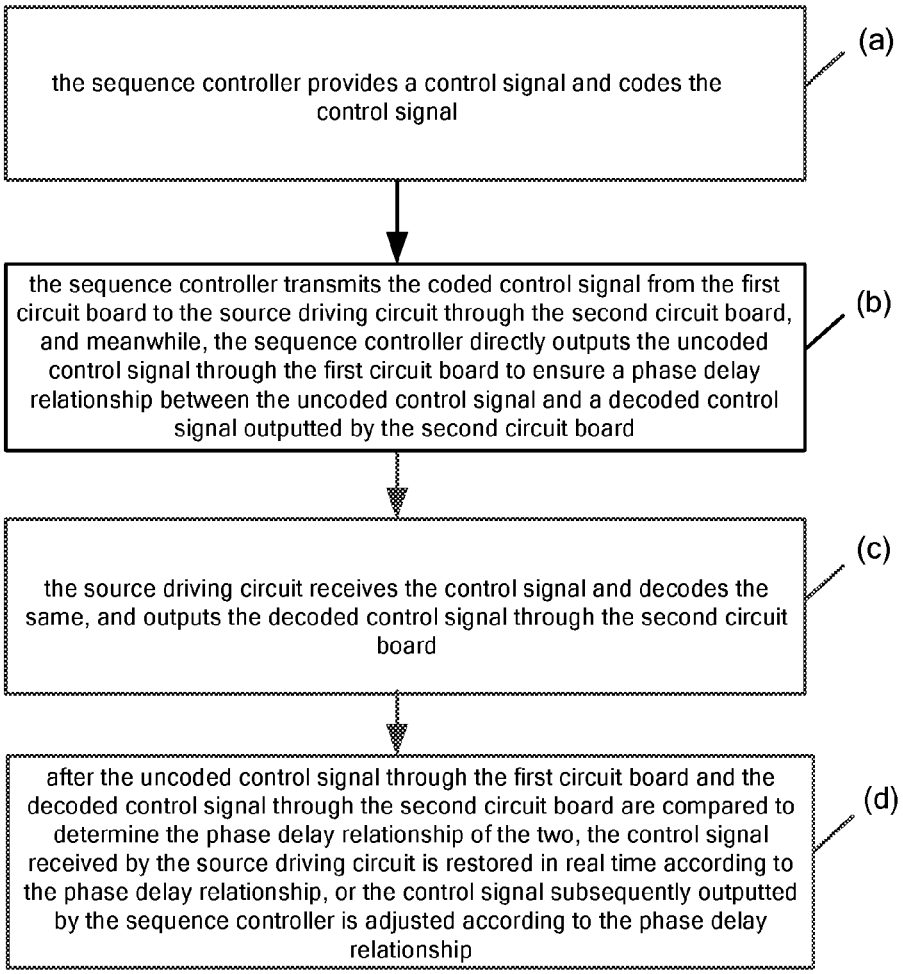
FIG. 2 is a flowchart of a control signal debugging method in the embodiment of the present invention.

Please refer to FIG. 2. FIG. 2 is a flowchart of a control signal debugging method in the embodiment of the present invention. The control signal debugging method shown in FIG. 2 is applied to the liquid crystal display shown in FIG. 1. The control signal debugging method at least comprises steps of:

(a) the sequence controller 11 provides a control signal and codes the control signal; in this preferred embodiment, the control signal comprises a data source row latch signal (TP) and a signal (POL) controlling polarity reversal of a pixel voltage;

(b) the sequence controller 11 transmits the coded control signal from the first circuit board 10 to the source driving circuit 50 through the second circuit board 30, and meanwhile, the sequence controller 11 also directly outputs the uncoded control signal through the first circuit board 10; specifically, it is outputted through the first test point 13 of the first circuit board 10, and thus, the test apparatus can be coupled to the first test point 13 to measure the waveform and the sequence of the control signal in real time.

Correspondingly, the amount of the first test points 13 is two, which respectively are employed to output the uncoded data source row latch signal and polarity reversal signal. In this preferred embodiment, the control signal is outputted to the first test point 13 in a way of transistor-transistor logic voltage level, and the test apparatus can be coupled to the first test point 13 to measure the waveform and the sequence of the control signal in real time;

(c) the source driving circuit 50 receives the control signal and decodes the same, and outputs the decoded control signal through the second circuit board 30; specifically, the source driving circuit 50 decodes the control signal received from the second circuit board 30, and outputs the decoded control signal to the second test point 31, and outputs through the second test point 31;

(d) after the uncoded control signal outputted by the first circuit board 10 and the decoded control signal outputted by the second circuit board 30 are compared, the phase delay relationship of the two can be determined; specifically, after the uncoded control signal through the first circuit board 10 and the decoded control signal through the second circuit board 30 are compared to determine the phase delay relationship of the two, the control signal received by the source driving circuit 50 can be restored in real time according to the phase delay relationship, or the control signal subsequently outputted by the sequence controller 11 can be adjusted according to the phase delay relationship.

In conclusion, the liquid crystal display and the control signal debugging method thereof according to the present invention can be directly coupled to the external test apparatus through the first test point 13 of the first circuit board 10 to measure the waveform and the sequence of the control signal outputted by the sequence controller 11 in real time and determine whether they are correct. Besides, the liquid crystal display and the control signal debugging method thereof according to the embodiment of the present invention also can ensure a phase delay relationship between the uncoded control signal outputted by the first circuit board 10 and the decoded control signal outputted by the second circuit board 30 to adjust the control signal outputted by the sequence controller 11 according to the phase delay relationship.

In the description of the present specification, the reference terms, "one embodiment", "some embodiments", "an illustrative embodiment", "an example", "a specific example", or "some examples" mean that such description combined with the specific features of the described embodiments or examples, structure, material, or characteristic is included in the utility model of at least one embodiment or example. In the present specification, the terms of the above schematic representation do not certainly refer to the same embodiment or example. Meanwhile, the particular features, structures, materials, or characteristics which are described may be combined in a suitable manner in any one or more embodiments or examples.

Above are embodiments of the present invention, which does not limit the scope of the present invention. Any modifications, equivalent replacements or improvements within the spirit and principles of the embodiment described above should be covered by the protected scope of the invention.

What is claimed is:

1. A liquid crystal display, comprising a first circuit board and a second circuit board and a source driving circuit which are electrically coupled to the first circuit board, wherein the first circuit board comprises a sequence controller, and the sequence controller provides a control signal and codes the control signal, and transmits the coded control signal from the first circuit board to the source driving circuit through the second circuit board, and the sequence controller directly outputs the uncoded control signal through the first circuit board to ensure a phase delay relationship between the uncoded control signal and a control signal outputted by the source driving circuit, wherein the source driving circuit receives the control signal and decodes the same, and outputs the decoded control signal through the second circuit board; after the uncoded control signal through the first circuit board and the decoded control signal through the second circuit board are compared to determine the phase delay relationship of the two, the control signal received by the source driving circuit is restored in real time according to the phase delay relationship, or the control signal subsequently outputted by the sequence controller is adjusted according to the phase delay relationship.

2. The liquid crystal display according to claim 1, wherein the control signal comprises a data source row latch signal and a signal controlling polarity reversal of a pixel voltage.

3. The liquid crystal display according to claim 1, wherein the first circuit board is a X board of the liquid crystal display.

4. The liquid crystal display according to claim 1, wherein the second circuit board is a C board of the liquid crystal display.

5. The liquid crystal display according to claim 1, wherein the first circuit board comprises a first test point, and the second circuit board comprises a second test point, and the first test point and the second test point are coupled to an external test apparatus to measure a waveform and a sequence of the control signal in real time.

6. The liquid crystal display according to claim 1, wherein the first circuit board comprises a first test point, and the second circuit board comprises a second test point, and the first test point and the second test point are coupled to an external test apparatus to measure a waveform and a sequence of the control signal in real time.

7. The liquid crystal display according to claim 2, wherein the first circuit board comprises a first test point, and the second circuit board comprises a second test point, and the first test point and the second test point are coupled to an external test apparatus to measure a waveform and a sequence of the control signal in real time.

8. The liquid crystal display according to claim 3, wherein the first circuit board comprises a first test point, and the second circuit board comprises a second test point, and the first test point and the second test point are coupled to an external test apparatus to measure a waveform and a sequence of the control signal in real time.

9. The liquid crystal display according to claim 4, wherein the first circuit board comprises a first test point, and the second circuit board comprises a second test point, and the first test point and the second test point are coupled to an external test apparatus to measure a waveform and a sequence of the control signal in real time.

10. A control signal debugging method applied in a liquid crystal display, and the liquid crystal display comprises a first circuit board and a second circuit board and a source driving circuit which are electrically coupled to the first circuit board, and the first circuit board comprises a sequence controller, and the control signal debugging method comprises:

the sequence controller provides a control signal and codes the control signal; and the sequence controller transmits the coded control signal from the first circuit board to the source driving circuit through the second circuit board, and meanwhile, the sequence controller directly outputs the uncoded control signal through the first circuit board to ensure a phase delay relationship between the uncoded control signal and a decoded control signal outputted by the second circuit board, wherein the control signal debugging method further comprises steps of:

the source driving circuit receives the control signal and decodes the same, and outputs the decoded control signal through the second circuit board; and after the uncoded control signal through the first circuit board and the decoded control signal through the second circuit board are compared to determine the phase delay relationship of the two, the control signal received by the source driving circuit is restored in real time according to the phase delay relationship, or the control signal subsequently outputted by the sequence controller is adjusted according to the phase delay relationship.

11. The control signal debugging method according to claim 10, wherein the control signal comprises a data source row latch signal and a signal controlling polarity reversal of a pixel voltage.

12. The control signal debugging method according to claim 10, wherein the first circuit board is a X board of the liquid crystal display, and the second circuit board is a C board of the liquid crystal display.

13. The control signal debugging method according to claim 10, wherein the first circuit board is a X board of the liquid crystal display, and the second circuit board is a C board of the liquid crystal display.

14. The control signal debugging method according to claim 11, wherein the first circuit board is a X board of the liquid crystal display, and the second circuit board is a C board of the liquid crystal display.

15. The control signal debugging method according to claim 10, wherein the first circuit board comprises a first test point, and the second circuit board comprises a second test point, and the first test point and the second test point are coupled to an external test apparatus to measure a waveform and a sequence of the control signal in real time.

16. The control signal debugging method according to claim 10, wherein the first circuit board comprises a first test point, and the second circuit board comprises a second test point, and the first test point and the second test point are coupled to an external test apparatus to measure a waveform and a sequence of the control signal in real time.

17. The control signal debugging method according to claim 11, wherein the first circuit board comprises a first test point, and the second circuit board comprises a second test point, and the first test point and the second test point are coupled to an external test apparatus to measure a waveform and a sequence of the control signal in real time.

18. The control signal debugging method according to claim 12, wherein the first circuit board comprises a first test point, and the second circuit board comprises a second test point, and the first test point and the second test point are coupled to an external test apparatus to measure a waveform and a sequence of the control signal in real time.

* * * * *